US008628599B2

(12) United States Patent
Earthman et al.

(10) Patent No.: US 8,628,599 B2
(45) Date of Patent: Jan. 14, 2014

(54) DIAMONDOID STABILIZED FINE-GRAINED METALS

(75) Inventors: James C. Earthman, Irvine, CA (US); Farghalli A. Mohamed, Huntington Beach, CA (US); Rahul K. Mishra, Cockeysville, MD (US); Indranil Roy, Liberal, KS (US)

(73) Assignee: The Regents of the University of California, Oakland, CA (US)

( * ) Notice: Subject to any disclaimer, the term of this patent is extended or adjusted under 35 U.S.C. 154(b) by 955 days.

(21) Appl. No.: 12/204,763

(22) Filed: Sep. 4, 2008

(65) Prior Publication Data

US 2009/0061229 A1 Mar. 5, 2009

Related U.S. Application Data

(60) Provisional application No. 60/969,740, filed on Sep. 4, 2007.

(51) Int. Cl.

| | |
|---|---|
| ***B22F 1/00*** | (2006.01) |
| ***B22F 1/02*** | (2006.01) |
| ***C22C 1/05*** | (2006.01) |

(52) U.S. Cl.
USPC ..... 75/252; 428/402; 419/32

(58) Field of Classification Search
USPC ..... 75/252; 428/402; 419/32
See application file for complete search history.

(56) References Cited

U.S. PATENT DOCUMENTS

| | | | | |
|---|---|---|---|---|
| 7,273,598 | B2 * | 9/2007 | Dahl et al. | 423/446 |
| 2006/0153728 | A1 * | 7/2006 | Schoenung et al. | 419/32 |

OTHER PUBLICATIONS

C. Suryanarayana: Int. Mater. Rev., 1995, vol. 40, pp. 41-64.
M. Gell: Mater.Sci.Eng., 1995,vol.A204, pp. 246-251.
H. Gleiter: Nanostruct.Mater.,1992, vol. 1,pp. 1-19.
R. Birringer, H. Gleiter, H.P. Kelien, and P. Marquardt: Phys. Lett., 1984, vol. A102, pp. 356-360.
A. Inoue: Mater.Sci.Eng. A, 1994, vols. 179-180, pp. 57-61.
G.D. Hughes, S.D. Smith, C.S. Pande, H.R. Johnson and R.W. Armstrong: Scripta Metall.,1986,vol. 20,pp. 93-97.
Z.G. Li and D.J. Smith: Appl.Phys.Lett., 1989, vol. 55, pp. 919-923.
K. Lu and J.T. Wang: J.Appl Phys., 1991, vol. 69, pp. 522-531.
M.L. Mandich, V.E, Bondybey and W.D. Reents: J.Chem. Phys., 1987, vol. 86, pp. 4245-4255.

(Continued)

*Primary Examiner* — Weiping Zhu
(74) *Attorney, Agent, or Firm* — Shimokaji & Assoc., P.C.

(57) ABSTRACT

Thermal stability of cryomilled Al+1% diamantane was investigated in the temperature range of 423 to 773K. Diamantane is a nanosized hydrocarbon molecule with a 14 carbon atom diamond cubic framework that is terminated by hydrogen atoms. Following the cryomilling of the Al powders and diamantane cages, the average grain size characterized using transmission electron microscopy (TEM) and X-ray diffraction (XRD). The as-cryomilled grain sized was found to be of the order of 22 nm, essentially the same as that for Al cryomilled without diamantane. To determine thermal stability, the powders were sealed in glass tubes in an Ar atmosphere to avoid oxidation and contamination and annealed at different temperatures between 423 and 773K for different holding times. Following these treatments, the grain size of cryomilled Al+1% diamantane was consistently less than that for cryomilled Al by about a factor of two. Preliminary investigations indicate that the grain growth exponent n decreased with increasing temperature, reaching a value of approximately 35 at 423 K. Such a high value of n suggests the operation of strong pinning forces on boundaries during annealing treatment. The thermal stability data were found to be consistent with Burke's model based on drag forces exerted by dispersion particles.

19 Claims, 6 Drawing Sheets

(56) References Cited

OTHER PUBLICATIONS

V.M. Segal, V.I. Reznikov, A.E.Drobyshevskiy and V.I.Kopylov: Metally., 1981, vol. 1, pp. 11523.
H.J. Fecht: Nano-Struct. Mater., 1995, vol. 6, pp. 33-42.
P.G. Shewmon: Transformation in Metals, McGraw-Hill, New York, 1969, pp. 300.
R.J. Perez, H.G. Jiang, C.P. Dogan and E.J. Lavernia: Met. & Mat. Trans.A., 1998, vol. 29A, pp. 2469-2475.
F. Zhou, J. Lee, S. Dallek, and E.J. Lavernia: J. Mater.Res., 2001, vol. 16, pp. 3451-3458.
I. Roy, M. Chauhan, E.J. Lavernia, F.A. Mohamed: Met & Mat Trans A., 2006, vol. 37A, 721-30.
J.E. Burke: Trans.TMS-AIME, 1949, vol. 180, pp. 73-79.
J.E. Dahl, S.G. Liu, R.M.K. Carlson: Science, 2003, vol. 299, pp. 96-99.
M.J. Luton, C.S. Jayanth, M.M. Disko, S. Matras, and J. Vallone: Mater. Res. Soc. Symp. Proc., Pittsburgh, PA , 1989, vol. 132, pp. 79.
T. Yamasaki: Mater. Phys. Mech., 2000, vol. 1, pp. 127-132.
D. Choi, H. Kim, W.D. Nix: IEEE J. Microelctromech. Sys., 2004, vol. 13, pp. 230-237.
B.D. Cullity: Elements of X-ray Diffraction, Addison-Wesley, Reading, MA, 1978, p. 101.
V.L.TellKamp, S.Dallek, D.Cheng and E.J.Lavernia: J. Mat. Res. Soc, 2001, vol. 16, pp. 938-944.
J.S.Benjamin and T.E.Volin: *Metall. Trans. A*, 1974, vol. 5, pp. 1929-1934.
Y. Xun, E.J. Lavernia and F.A. Mohamed, *Metall. Mater. Trans. A.*, 2004, vol. 35A, pp. 573-581.
P.A. Beck, J. Towers, and W.D. Manly: Trans. TMS-AIME, 1947, vol. 175, pp. 162-177.
T.R. Malow and C.C. Koch: Acta Mater., 1997, vol. 45, pp. 2177-2186.
H.L., Chung et al., 2001, vol. 388, pp. 101-106.
A. Michels, C.E. Krill, H. Ehrhardt, A. Birringer, and D.T. Wu: Acta Mater., 1997, vol. 47, pp. 2143-2152.
F.A. Mohamed and T.G. Langdon: Metal. Trans., 1974, vol. 5, pp. 2339-2395.

* cited by examiner

DIAMONDOID STABILIZED FINE-GRAINED METALS

This invention was made with Government support under contract number D-DMR-0304629, awarded by the National Science Foundation. The Government has certain rights in this invention.

BACKGROUND OF THE INVENTION

The present invention generally relates to stabilized and strengthened metals and, more specifically, to metals stabilized and strengthened, especially at high temperatures, by the addition of diamondoid.

Nano crystalline materials are defined as single or multi-phase polycrystals with grain size less than 100 nm in at least one dimension. Considerable recent evidence has indicated that nanocrystalline alloys may provide mechanical and electrical properties superior to those of their coarse-grained counterparts. (C. Suryanarayana: Int. Mater. Rev., 1995, vol. 40, pp. 41-64. M. Gell: Mater.Sci.Eng., 1995, vol.A204, pp. 246-51. H. Gleiter: Nanostruct. Mater., 1992, vol. 1, pp. 1-19.) This potential superiority results from the reduced dimensionality of nanometer-sized crystallite as well as from the numerous interfaces between adjacent crystallite. (H. Gleiter: Nanostruct. Mater., 1992, vol. 1, pp. 1-19.) A number of processing techniques are currently available to produce nc materials including inert gas condensation (R. Birringer, H. Gleiter, H. P. Kelien, and P. Marquardt: Phys. Lett., 1984, vol. A102, pp. 356-60.), rapid solidification (A. Inoue: Mater.Sci.Eng. A, 1994, vols. 179-180, pp. 57-61.), electrodeposition (G. D. Hughes, S. D. Smith, C. S. Pande, H. R. Johnson and R. W. Armstrong: Scripta Metall., 1986, vol. 20, pp. 93-97.), sputtering (Z. G. Li and D. J. Smith: Appl. Phys.Lett., 1989, vol. 55, pp. 919-23.), crystallization of amorphous phases (K. Lu and J. T. Wang: J.Appl Phys., 1991, vol. 69, pp 522-31.), laser ablation (M. L. Mandich, V. E, Bondybey and W. D. Reents: J. Chem. Phys., 1987, vol. 86, pp. 4245-55.), chemical processing (V. M. Segal, V. I. Reznikov, A. E. Drobyshevskiy and V. I. Kopylov: Metally., 1981, Vol. 1, pp. 11523.). Comparison of these methods in terms of cost and productivity demonstrates that ball milling is the most cost effective route capable of producing nc materials in large quantity. During the milling process, extreme cyclic deformation is induced in the powders as they undergo repeated welding, fracturing and rewelding. Thus, the resulting nanostructure is produced by structural decomposition of coarse grains as the result of severe plastic deformation. (H. J. Fecht: Nano-Struct. Mater., 1995, vol. 6, pp. 33-42.)

Rapid and extensive grain growth generally occurs during elevated temperature consolidation of cryomilled powders undermining the significant progress that has been achieved in the synthesis of nanocrystalline precursors. Nanoscale grains tend to be highly unstable in this regard. For example, the Gibbs-Thomson equation (P. G. Shewmom: Transformation in Metals, McGraw-Hill, New York, 1969, pp. 300.) predicts that the driving force for grain growth increases substantially with decreasing grain size to the nanoscale. Accordingly, recent studies have investigated ways in which the thermal stability of nanocrystalline microstructure might be enhanced. For example, added thermal stability for cryomilled nanostructures is attributed to the pinning of grain boundaries by a dispersion of second-phase $Al_2O_3$, AlN and $Al_4C_3$ particles. (R. J. Perez, H. G. Jiang, C. P. Dogan and E. J. Layernia: Met. & Mat. Trans.A., 1998, vol 29A, pp. 2469-75. F. Zhou, J. Lee, S. Dallek, and E. J. Layernia: J. Mater.Res., 2001, vol. 16, pp. 3451-58.) These dispersions are incoherent nanoscale second-phase particles, highly stable at high temperatures and insoluble in matrix. At elevated temperature, they favorably segregate to the grain boundaries and act as an effective barrier (dispersion strengthening) to the movement of grain boundaries. (I. Roy, M. Chauhan, E. J. Layernia, F. A. Mohamed: Met & Mat Trans A., 2006, vol 37A, 721-30. J. E. Burke: Trans.TMS-AIME, 1949, vol. 180, pp. 73-79.)

As can be seen, there is a need for improved stabilized metals, especially for metals made from nano crystalline materials which may be stabilized at high temperatures.

SUMMARY OF THE INVENTION

In one aspect of the present invention, diamantane in the powder form is mixed with Al powder and then cryomilled for 8 hours in order to fully disperse diamantane into the nanocrystalline Al prior to consolidation. Diamantane (also referred to as diamondoid) is a hydrocarbon molecule with a 14 carbon (C) atom diamond cubic framework that is terminated by hydrogen atoms. (J. E. Dahl, S. G. Liu, R. M. K. Carlson: Science, 2003, vol. 299, pp. 96-99.) These C cages are nanosized (<2 nm) molecules and their diamond face-fused cage structure gives them high stability, strength and rigidity. One aspect of the present invention is to examine the effect of a 1 wt % diamantane addition on the thermal stability of grain size for nanocrystalline aluminum.

In another aspect of the present invention, a stabilized metal comprises metal particles and diamantane particles.

In yet another aspect of the present invention, a metal composition comprises nonocrystalline metal particles and about 1 to about 5 weight % diamantane particles.

In a further aspect of the present invention, a method for making a stabilized metal, the method comprises cryomilling nanocrystalline metal particles with diamantane particles to form a milled composition; and annealing the milled composition to form the stabilized metal.

These and other features, aspects and advantages of the present invention will become better understood with reference to the following drawings, description and claims.

DETAILED DESCRIPTION OF THE INVENTION

Figure 1A:
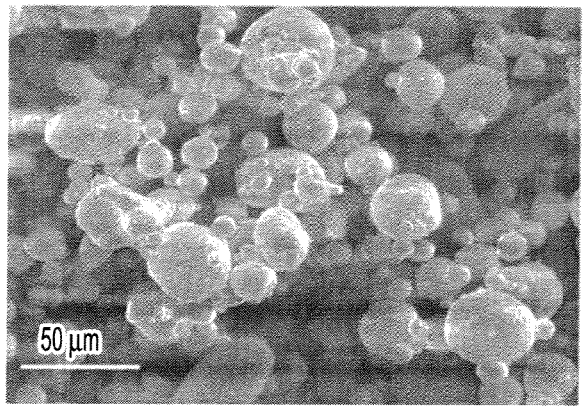
FIG. 1A is a pictoral representation of Al+1% diamantane alloy according to the present invention, as-received prior to cryomilling.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Experimental Procedure

The diamantane material (diamanoids) used in examples below was provided by Chevron Molecular Diamond.

Nanocrystalline commercial purity (CP) Al with 1 weight percent of diamantane powder was produced by mechanical milling of a slurry of both CP Al and the diamantane powder in liquid nitrogen (cryomilling). The detailed description of this cryomilling processing method is described elsewhere. (M. J. Luton, C. S. Jayanth, M. M. Disko, S. Matras, and J. Vallone: Mater. Res. Soc. Symp. Proc., Pittsburgh, Pa., 1989, vol. 132, pp. 79.) Following a simple treatment by Yamasaki (T. Yamasaki: Mater.Phys.Mech., 2000, vol. 1, pp. 127-132.), the volume fraction of grain boundaries in a nanocrystalline material can be approximated by $$f_{gb} = 1 - \left(\frac{d - \Delta}{d}\right)^3 \quad (1)$$

where d is the grain size and A is the grain boundary thickness. Previous work on cryomilled CP Al powders yielded average grain sizes on the order of 40 nm. (F. Zhou, J. Lee, S. Dallek, and E. J. Layernia: J. Mater.Res., 2001, vol. 16, pp. 3451-58.) Further, a good estimate of the grain boundary thickness for the CP Al with diamantane according to the present invention is about 0.5 nm. (D. Choi, H. Kim, W. D. Nix: IEEE J. Microelctromech. Sys., 2004, Vol. 13, pp. 230-37.) Using these values in Eq. (1), we obtain $f_{gb}$ E 0.04. As a conservative estimate, the amount of diamantane required to completely fill the grain boundaries should be sufficient to account for about half of this volume fraction assuming that the diamantane is primarily distributed along the grain boundaries as a result of cryomilling. For this requirement, the necessary composition of diamantane is given by $C_{dia}=f_{gb}\,\rho_{dia}/2\,\rho_{Al}$ where $\rho_{dia}$ and $\rho_{Al}$ are the densities of diamantane and Al, respectively. For $\rho_{dia}=1.2\ g\ cm^{-3}$ and $\rho_{Al}=2.7\ g\ cm^{-3}$, the required addition of diamantane for complete coverage on the grain boundaries is estimated to be 0.9% by weight. Accordingly, a 1% addition of diamantane was used in the present study in order to achieve a significant effect on grain boundary stability at elevated temperatures.

The milling was performed in a modified Union Process 01-HD attritor with a stainless steel vial at a rate of 180 rpm. Stainless steel balls (6.4 mm diameter) were used with a ball-to-powder weight ratio of 32:1. During the milling operation, liquid nitrogen was added directly into the mill to maintain complete immersion of the milling media. Prior to milling, approximately 0.2 wt % stearic acid [$CH_3(CH_2)_{16}CO_2H$] was added to the powders as a process control agent to prevent adhesion of the powders to the milling tools during the process.

For thermal stability, the cryomilled Al+1% diamantane powder was sealed in glass tubes in an inert atmosphere (under Argon) to avoid oxidation and contamination. The samples were then annealed in a Cress C-601K electrical furnace at 423, 473, 523, 573, 623, 673, 723, or 773K, for times ranging from 0.5 to 10 hours.

X-ray diffraction (XRD) measurements were performed with a Siemens D5000 diffractometer equipped with a graphite monochromator using Cu Kα radiation (A=0.1542 nm) at 100 steps per degree and a count time of 8 s per step. Following subtraction of the instrumental broadening and $K\alpha_2$ components, the full width half maximum (FWHM) and integral breadth for five prominent face-centered-cubic (FCC) Al peaks (111, 200, 220, 311, 222) was measured to calculate grain size (B. D. Cullity: Elements of X-ray Diffraction, Addison-Wesley, Reading, Mass., 1978, p. 101.) for the cryomilled Al+1% diamantane sample. Scanning electron microscopy was performed using a FEI/Philips XL-30 microscope to determine the average particles size and their general morphology. The transmission electron microscopy (TEM) samples were prepared by suspending the nanostructured powders in methanol, agitating the solution by hand, and submersing a Cu TEM grid into the solution. This caused the nanostructured powders to adhere to the Cu TEM grid. TEM micrographs were produced using a Philips CM20 microscope operated at 200 KV.

Results

Figure 1B:
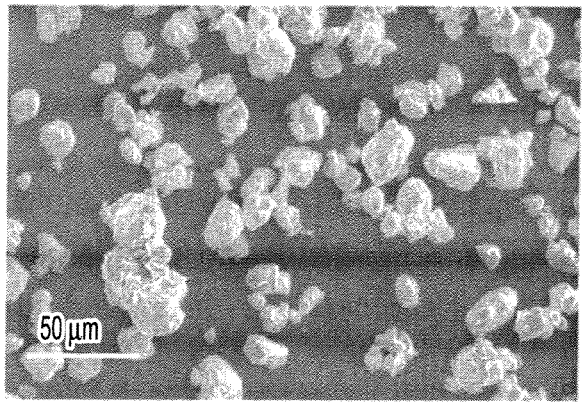
FIG. 1B is a pictoral representation of Al+1% diamantane alloy according to the present invention, after 8 hours of cryomilling.

The morphological evolution of the Al+1% diamantane alloy during cryomilling was found to closely follow the stages with conventional mechanical alloying processes. For example, the shapes of the particles, which look spherical in the as-received sample (FIG. 1*a*), become flattened after 8 hours of cryomilling (FIG. 1*b*). The average particle size of Al+1% diamantane after 8 hours of cryomilling is smaller than that observed for cryomilled Al without diamantane additions by about a factor of 2 with an average diameter of 13 μm.

Figure 2:
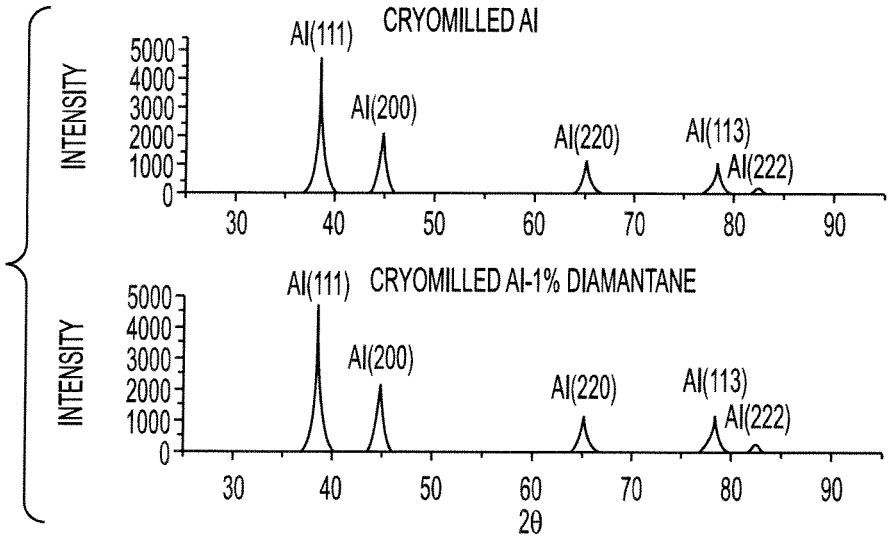
FIG. 2 are graphs showing X-ray diffraction spectra of the peak of cryomilled Al and cryomilled Al+1% diamantane alloy according to the present invention.

FIG. 2 shows the XRD spectra of cryomilled Al (F. Zhou, J. Lee, S. Dallek, and E. J. Layernia: J. Mater.Res., 2001, vol. 16, pp. 3451-58.) and cryomilled Al+1% diamantane. Comparing peaks of cryomilled Al without diamantane with the corresponding peak for cryomilled Al+1% diamantane, no shift can be seen in the peak position or peak broadening phenomenon as a result of the diamantane addition. Thus, the presence of the diamantane produced little or no lattice strain in the aluminum matrix and the grain size of cryomilled Al+1% diamantane should be essentially same as that for Al cryomilled without the diamantane addition. Both of these observations that are derived from the nature of XRD peaks were also supported by estimating lattice strain using the integral breadth method and measuring grain size using XRD techniques as well as TEM micrographs. For example, the average grain size for cryomilled Al+1% diamantane using representative TEM micrographs was determined to be less than 30 nm, typically about 22 nm, which is very close to the average grain size value of 26 nm for cryomilled Al that does not contain diamantane. XRD was also utilized to obtain the average grain size of the cryomilled samples. This method indicated an average grain size that is very close to the grain size measured using TEM micrographs.

Figure 3:
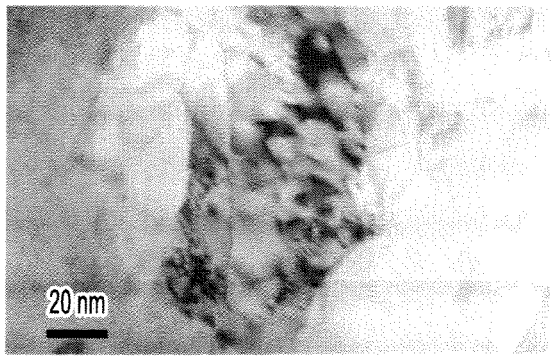
FIG. 3 is a pictoral representation of a transmission electron microscopy (TEM) bright field image of cryomilled Al+1% diamantane according to the present invention.

Following SEM and XRD, cryomilled Al+1% diamantane was investigated with transmission electron microscopy (TEM). FIG. 3 shows a TEM bright field image of cryomilled Al+1% diamantane revealing the nanosized grains that formed and dislocation pile-ups within a grain. These dislocations pile up in a manner that can lead to the formation of sub grains and subsequently forming nanosized grains with further deformation. This phenomenon of gradual change, starting from dislocation pile-up to sub-grains and then nanosized grains is stated as main mechanism for formation of nanosized grains as a result of cryomilling. (V. L. TellKamp, S. Dallek, D. Cheng and E. J. Layernia: J. Mat. Res.Soc, 2001, vol. 16, pp. 938-44.)

Figure 4:
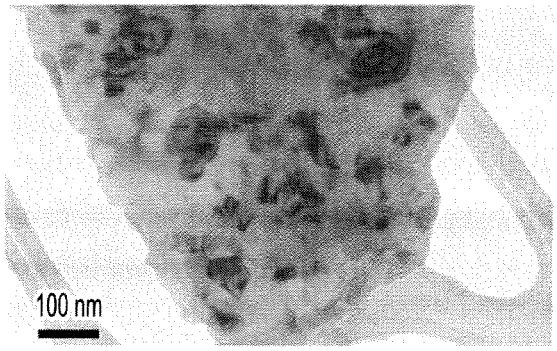
FIG. 4 is a pictoral representation of a TEM bright field image of cryomilled Al+1% diamantane alloy, according to the present invention, at higher magnification indicating nano sized grains.
Figure 5:
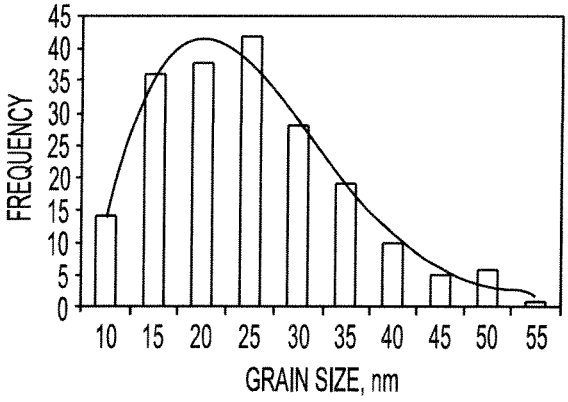
FIG. 5 is a graph showing grain size distribution for cryomilled Al+1% diamantane according to the present invention.

A TEM bright field image of cryomilled Al+1% diamantane alloy at higher magnification indicating nano sized grains (<100 nm) is presented in FIG. 4. Average grain size calculated from representative TEM micrographs was found to be 22 nm. Taking this value together with the observed mean particle size corresponds to approximately 590 grains per particle on average. FIG. 5 shows the grain size distribution for the present Al+1% diamantane alloy after cryomilling. This histogram demonstrates that, taking into account a resolution limit of 5 nm, the grain size is normally distributed about the mean.

Figure 6A:
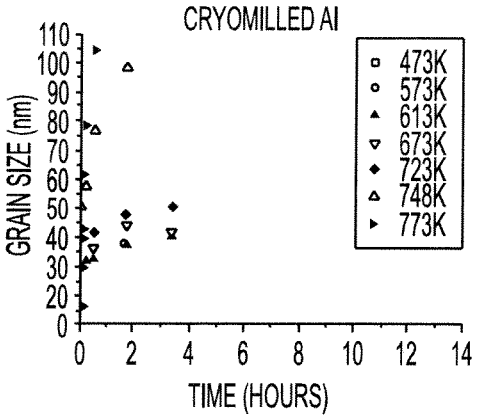
FIG. 6A is a graph showing grain size versus annealing time at various temperatures for conventional cryomilled CP Al.
Figure 6B:
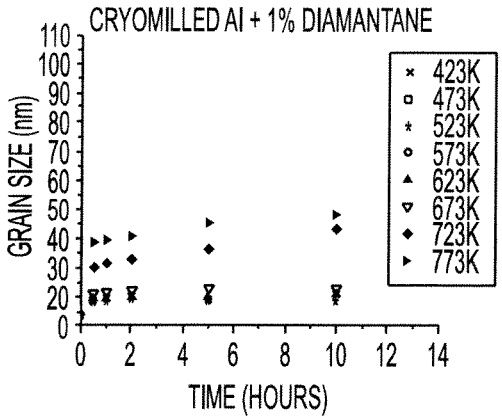
FIG. 6B is a graph showing grain size versus annealing time at various temperatures for CP Al with the addition of 1% diamantane according to the present invention.
Figure 7A:
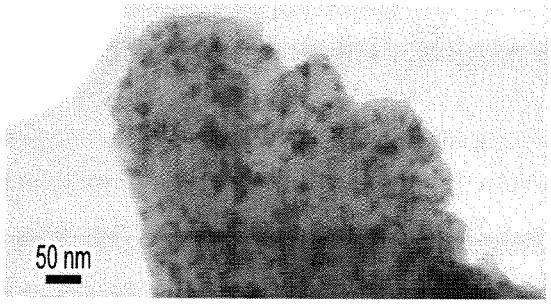
FIG. 7A is a pictoral representation of a TEM bright field image of cryomilled Al+1% diamantane alloy annealed at 423K for 1 hour.
Figure 7B:
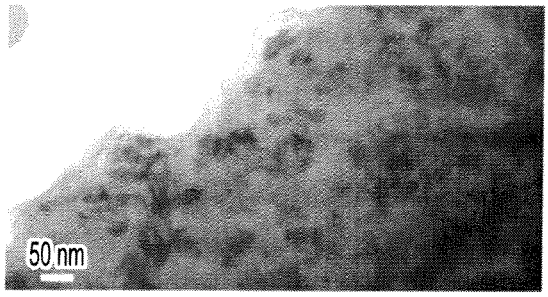
FIG. 7B is a pictoral representation of a TEM bright field image of cryomilled Al+1% diamantane allow annealed at 423K for 10 hours.
Figure 8A:
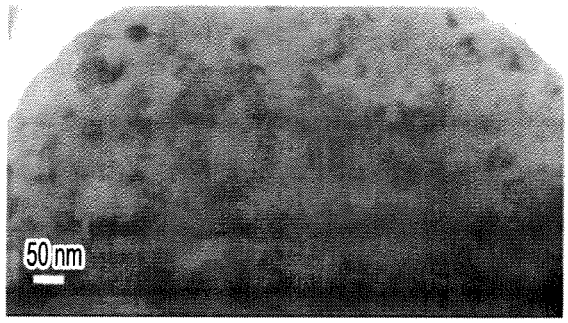
FIG. 8A is a pictoral representation of a TEM bright field image of cryomilled Al+1% diamantane alloy annealed at 773K for 1 hour.
Figure 8B:
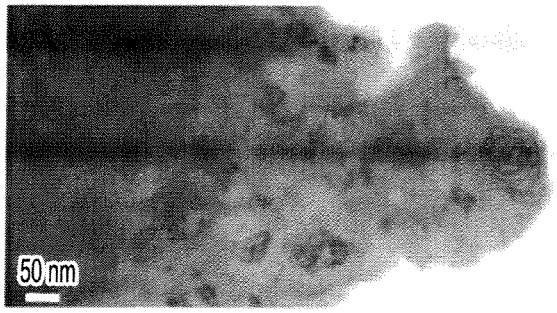
FIG. 8B is a pictoral representation of a TEM bright field image of cryomilled Al+1% diamantane allow annealed at 773K for 10 hours

Grain size versus annealing time for cryomilled Al from the work of Zhou et al. (F. Zhou, J. Lee, S. Dallek, and E. J. Layernia: J. Mater.Res., 2001, vol. 16, pp. 3451-58.) is compared in FIGS. 6A and 6B. with that for cryomilled Al+1% diamantane. Zhou and coworkers annealed specimens in the temperature range of 473K-773K (0.51-0.83 $T_m$) for a duration ranging from 0 to 3 hours. For the present invention, a slightly broader temperature range was employed (0.45 $T_m$ to 0.83 $T_m$) as well as longer durations (1 to 10 hours). An examination of FIG. 6B reveals three observations: (i) the grain size increases with increasing temperature; (ii) for a given temperature, the growth rate decreases with increasing annealing time; and (iii) significant grain growth is observed at temperatures higher than 698 K. It is noted that the grain size remained below 100 nm at even the highest temperatures. Supporting these findings, TEM micrographs of Al+1% diamantane annealed for 1 hour (FIG. 7A) and 10 hours (FIG. 7B) are presented at 423K, and also in FIG. 8A (1 hour) and FIG. 8B (10 hours) at 773K. For relatively low temperatures (e.g. 423K), visual inspection of TEM micrographs reveals no obvious increase in grain size even after annealing for 10 hours as demonstrated in FIG. 7B. However, it appears the measurements in FIGS. 6A and 6B that there are a significant number of nanosized grains that undergo limited growth. This increase may correspond to recovery of some low angle boundaries, a phenomenon that facilitates the reduction of stored energy by the removal or rearrangement of dislocations. This explanation is supported by the observation of low angle boundaries in the as-cryomilled powders and their apparent absence in all of the specimens that were heated treated. By contrast, significant grain growth occurs at higher temperature regime (above 69K) with average grain size reaching the range of 50-100 nm. It is worth mentioning that although there is a significant increase in grain size initially in this temperature regime, grain size does not change much over long times. For example, a TEM micrograph of a specimen heated at temperature 773K is shown in FIGS. 8A and 8B. It can be seen in this figure that the grain size distribution remains essentially the same even after annealing at this higher temperature for 10 hours (FIG. 8B).

These data clearly indicate superiority of Al+1% diamantane alloy over cryomilled Al without diamantane additions in terms of the stability of the grain size. Specifically, the grain size for Al+1% diamantane is less than that for cryomilled Al by about a factor of two over the entire temperature range. Perhaps most notable is that the grain size stays in the nano range (<100 nm) at even the highest temperatures corresponding to 0.78 $T_m$ to 0.83 $T_m$ while, in the absence of diamantane, a grain size of 100 nm is exceeded for temperatures above 723K. (F. Zhou, J. Lee, S. Dallek, and E. J. Layernia: J. Mater.Res., 2001, vol. 16, pp. 3451-58.) A similar lack of thermal stability was observed for cryomilled 5083 Al—Mg at temperatures above 654K. (V. L. TellKamp, S. Dallek, D. Cheng and E. J. Layernia: J. Mat. Res.Soc, 2001, vol. 16, pp. 938-44.)

Discussion

Grain growth in conventional polycrystalline materials is normally controlled by atomic diffusion along grain boundaries. The kinetics of this process are frequently represented by the following empirical equation:

$$\gamma = kt^{(1/n)} \tag{2}$$

where $\gamma$ is the average instantaneous grain size, t is the annealing time, and k is a parameter that depends on temperature but is insensitive to the grain size. (J. S. Benjamin and T. E. Volin: Metall.Trans. A, 1974, vol. 5, pp. 1929-34. Y. Xun, E. J. Layernia and F. A. Mohamed: Met. Mater. Trans. A., 2004, vol. 35A, pp. 573-581. P. A. Beck, J. Towers, and W. D. Manly: Trans. TMS-AIME, 1947, vol. 175, pp 162-77.) The elementary theories of grain growth, predict a value of 2 for n for very pure metals or at high temperatures. However, experimental data have indicated that the value of n is significantly greater than 2 in most cases, and that it generally decreases with increasing temperature, approaching a lower limit of 2 for very pure metals or at very high temperatures. For example, n ranged from a value of 20 at low temperatures and decreased to about 3 at higher temperatures for grain growth in nanocrystalline Fe powder. T. R. Malow and C. C. Koch: Acta Mater., 1997, Vol. 45, pp. 2177-86.) Equation (2) is not valid during the early stages of grain growth when the initial grain size $\gamma_o$ is comparable with $\gamma$. Under this condition, grain growth can be expressed by the following general form $$\gamma^n - \gamma_o^n = kt \tag{3}$$

which reduces to Eq. (2) when $\gamma_o$ is very small compared to $\gamma$. (P. A. Beck, J. Towers, and W. D. Manly: Trans. TMS-AIME, 1947, vol. 175, pp. 162-77. By differentiating Eq. (3), the isothermal rate of grain growth can be represented by $$\frac{d\gamma}{dt} = \frac{k}{n}\left(\frac{1}{\gamma}\right)^{n-1} \tag{4}$$

Figure 9:
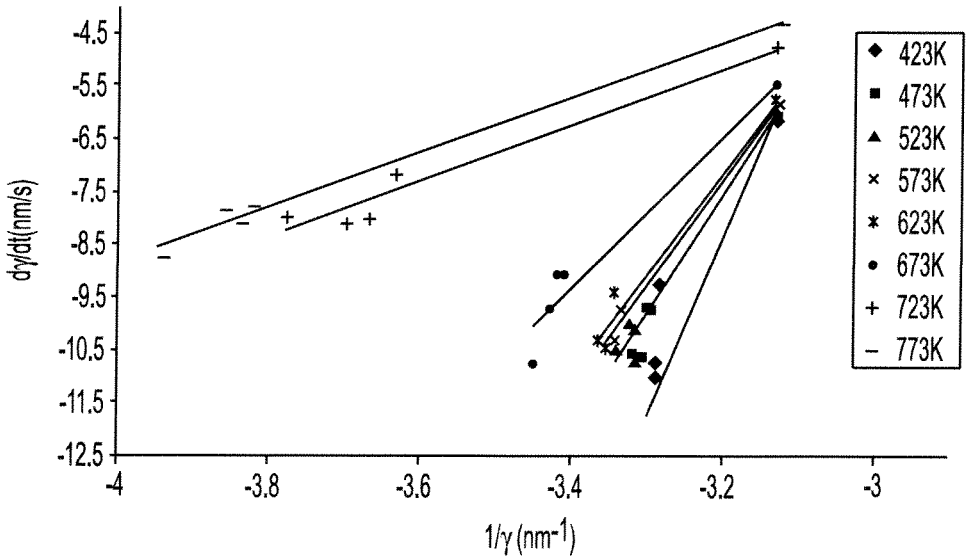
FIG. 9 is a graph showing instantaneous grain growth rate as a function of the instantaneous grain size on a double-logarithmic scale.
Figure 10:
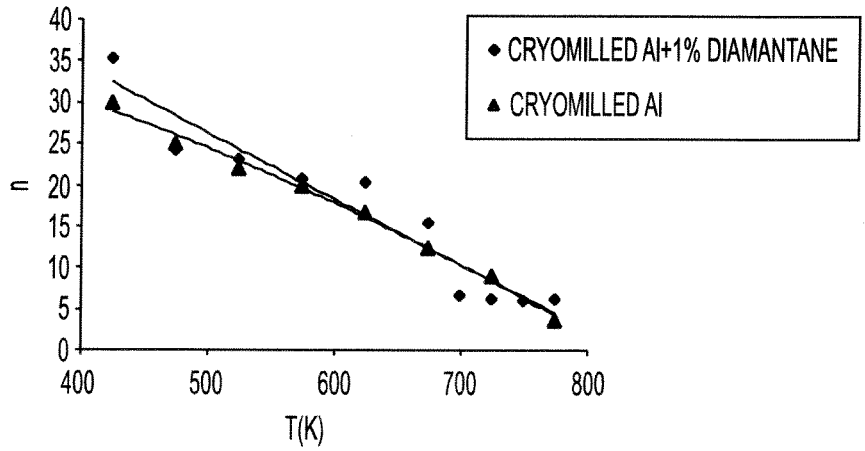
FIG. 10 is a graph showing grain growth exponent, n, as a function of annealing temperature.

Previous reports suggest that Eq. (4) should be employed to analyze the data on grain growth instead of Eq. 3). (I. Roy, M. Chauhan, E. J. Layernia, F. A. Mohamed: Met & Mat Trans A., 2006, vol 37A, 721-30.) In order to analyze the experimental data on the basis of Eq. (4) the instantaneous growth rate, dγ/dt, was plotted against 1/γ on a double-logarithmic scale in FIG. 9. The value of n was estimated from the slope of the straight line, which according to Eq. (4) is equal to (n−1). The resultant values of the grain growth exponent, n, for cryomilled Al+1% diamantane are plotted against the annealing temperature in FIG. 10. The corresponding value of n for cryomilled Al without diamantane (F. Zhou, J. Lee, S. Dallek, and E. J. Layernia: J. Mater.Res., 2001, vol. 16, pp. 3451-58.) is also shown in the same graph for comparison. An examination of FIG. 10 shows that the grain growth exponent, n, decreases with annealing temperature, a finding which is consistent with data reported for alloys processed by similar techniques. (T. R. Malow and C. C. Koch: Acta Mater., 1997 vol 45, pp. 2177-86.) For example, as the temperature increases from 423 to 773 K, the value of n decreases from 35 to 6.2 according to FIG. 10. The value of grain growth exponent n for Al+1% diamantane alloy is higher than that for cryomilled Al without diamantane over the entire temperature range (0.45-0.83 $T_m$). This result supporting TEM micrograph results which indicate that Al+1% diamantane has greater thermal stability than does cryomilled Al without diamantane. Zhou et al. have proposed that a value of n that is greater than 2 results from Zener pinning of the grain boundaries by particles. While not limiting the present invention to any particular theory, this pinning could be facilitated by the presence of the diamantane cages at the grain boundaries of the Al which, in turn, would explain the greater thermal stability of the grain size.

Figure 11:
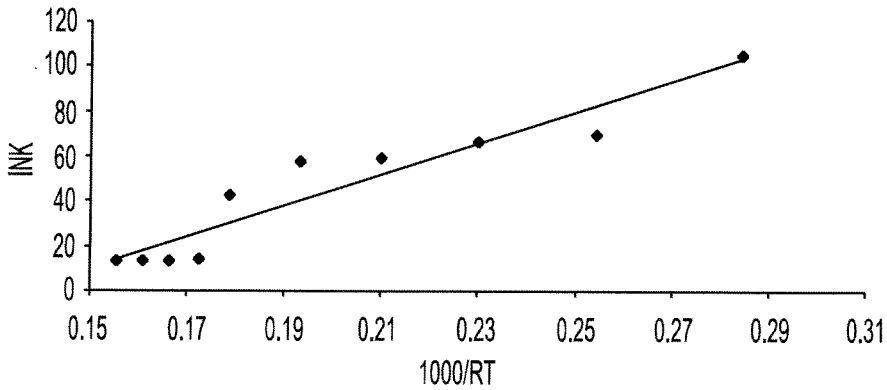
FIG. 11 is a graph showing natural logarithm of k as a function of 1000/RT to determine the activation energy of grain growth based on a normal grain growth theory.

The activation energy, Q, is often used to identify the microscopic mechanism that dominates grain growth. The rate constant k in Eq. (3) can be expressed by the Arrhenius equation:

$$k=k_0\exp(-Q/RT) \tag{5}$$

where Q is the activation energy for the grain growth, $k_0$ is a constant that is assumed to be independent of the temperature and time, and R is the molar gas constant. The values of k for different annealing temperatures can be determined using the values of n and the values of k/n determined from the slopes and the intercepts, respectively, of the linear fits to the data shown in FIG. 9. The natural logarithm of k is plotted versus 1000/RT in FIG. 11. According to Eq. (5), the slope of the plot gives the value of the activation energy. As indicated by FIG. 11, the data fit a curve with a positive slope which suggests that Eqs. (2) and (3) do not reasonably explain the observed grain growth and another possible mechanism needs to be sought. The observation that the grain size exponent, n, inferred from FIG. 10 is greater than 2 suggests the operation of strong pinning forces on boundaries during the annealing treatment.

Burke (J. E. Burke: Trans.TMS-AIME, 1949, vol. 180, pp. 73-79.) proposed that grain growth inhibition by dispersion particles is not predicted by Eq. (5). According to his model, the grain growth rate is not controlled by the instantaneous grain size, γ, but rather by the decreasing difference between the ultimate limiting grain size and the changing value of the instantaneous grain size. Burke's model may be expressed by the following equation:

$$\frac{\gamma_o-\gamma}{\gamma_m}+\ln\left(\frac{\gamma_m-\gamma_o}{\gamma_m-\gamma}\right)=\frac{k_o t}{\gamma_m^2}\exp\left(\frac{-Q}{RT}\right) \tag{6}$$

where $\gamma_m$ is the limiting ultimate grain size for the particular annealing temperature. In developing Eq. (6), Burke assumed that the drag force is independent of grain size. As indicated by Micheles et al. (A. Michels, C. E. Kril, H. Ehrhardt, R. Birringer, and D. T. Wu: Acta Mater., 1997, vol. 47, pp. 2143-52.), such an assumption is reasonable under the condition that the source of pinning does not depend on grain size. This situation exists when dispersion particles or pores produce pinning. By differentiating Eq. (6), the following basic growth rate equation is obtained:

$$\frac{d\gamma}{dt}=k\left(\frac{1}{\gamma}-\frac{1}{\gamma_m}\right) \tag{7}$$

Figure 12A:
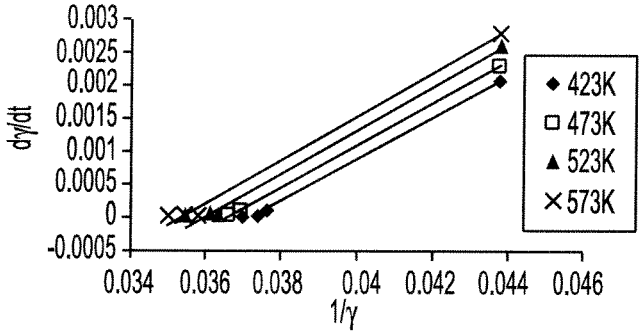
FIG. 12A is a graph of dγ against 1/γ on a linear scale yielding k (slope) and $k/\gamma_m$ (intercept) (a) for the temperatures 423,473,523 and 573.
Figure 12B:
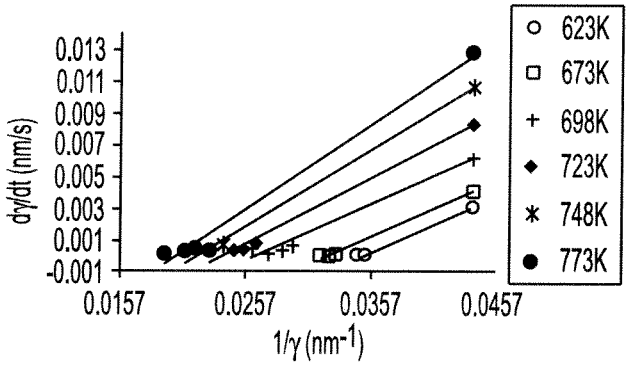
FIG. 12B is a graph of dγ against 1/γ on a linear scale yielding k (slope) and $k/\gamma_m$ (intercept) for the temperatures 623, 673, 723 and 773 K.

Eq. (7) implies that a plot of dγ/dt against 1/γ on a linear scale yields k (=slope) and $k/\gamma_m$(=dγ/dt axis intercept). This plot is shown in FIG. 12 for Al+1% diamantane exposed to different temperatures.

Figure 13:
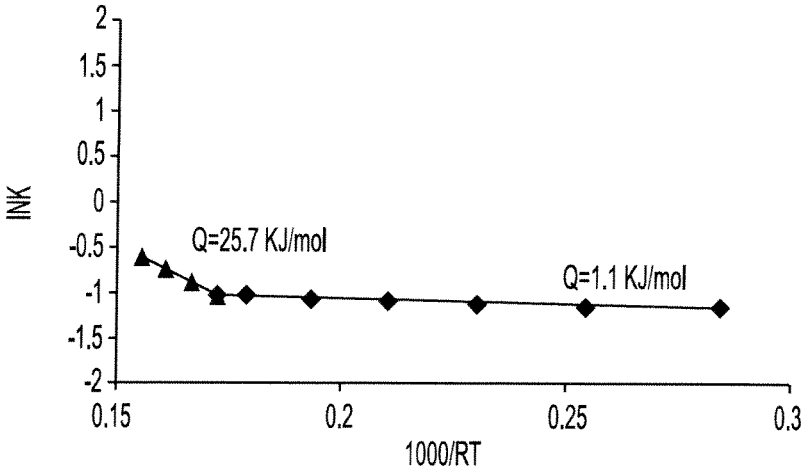
FIG. 13 is a graph of In(k) vs. 1000/RT in high and low-temperature regimes to determine the activation energy for grain growth when inhibited by dispersion particle drag

FIG. 13 shows In(k) plotted as a function of 1000/RT with the activation energies for two temperature regimes also given in accordance with Eq. (5). Grain growth kinetics data for cryomilled CP Al and Al alloy 5083 in powder (F. Zhou, J. Lee, S. Dallek, and E. J. Layernia: J. Mater.Res., 2001, vol. 16, pp. 3451-58. M. J. Luton, C. S. Jayanth, M. M. Disko, S. Matras, and J. Vallone: Mater. Res. Soc. Symp. Proc., Pittsburgh, Pa., 1989, vol. 132, pp. 79.) and bulk form (I. Roy, M. Chauhan, E. J. Layernia, F. A. Mohamed: Met & Mat Trans A., 2006, vol 37A, 721-30.) were reported previously in the literature. These results have also indicated that there are two different thermally activated processes during grain coarsening in cryomilled nanocrystalline Al. Thus, FIG. 13 demonstrates characteristics similar to that for other cryomilled Al alloys—an elevated temperature region that corresponds to relatively high activation energy, and a lower temperature region characterized by a reduced activation energy. These two activation energies and the corresponding transition temperature between them for other cryomilled Al alloys as well as the present invention are given in Table I.

TABLE I

Grain growth activation energies determined for cryomilled Al alloys.

| Authors | Materials | Transition Temperature (K) | $Q_H$ (KJ/mol) | $Q_L$ (KJ/mol) |
|---|---|---|---|---|
| Roy et.al. | Al5083 consolidated cryomilled alloy | 523 | 110 | 25 |
| TellKamp et.al. | Al5083 cryomilled powders | 654 | 142 | 5.6 |
| Zhou et.al. | Pure Al cryomilled powders | 723 | 112 | 79 |
| Present Invention | Al + 1% Diamantane cryomilled powders | 673 | 25 | 1.1 |

The activation energy for grain boundary diffusion (86 kJ/mol) and lattice diffusion (143.4 kJ/mol) reported for polycrystalline aluminum (F. A. Mohamed and T. G. Langdon: Metal. Trans., 1974, vol. 5, pp. 2339-95.) are both high compared to the observed activation energy of 25 kJ/mol for higher temperatures (T>673K). Accordingly, the observed activation energy for higher temperatures does not appear to correspond solely to grain growth by diffusion. Rather, this activation energy could be more characteristic of a stress relaxation process associated with the reordering of grain boundaries and recovery of low angle boundaries (I. Roy, M. Chauhan, E. J. Layernia, F. A. Mohamed: Met & Mat Trans A., 2006, vol 37A, 721-30.) as suggested by the dislocation arrays in FIG. 3. This process is accompanied by so little grain growth that the grain size remains nanocrystalline even after 10 hours at 773K. This activation energy value for the higher temperature regime for Al+1% diamantane, about 25 kJ/mol, is similar to that observed by Roy et al. for cryomilled ultra fine grained 5083 Al alloy but at lower temperatures (T<573K). As indicated in Table 1, the activation energy they measured for higher temperatures corresponded much more closely to that for grain growth.

It has been proposed previously that the two regimes of behavior characterized in Table 1 correspond to relaxation at lower temperatures and grain growth at the higher temperatures. However, the relatively low value of the activation energy for the higher temperature behavior observed in the present invention is closer in value to that for the lower temperature behavior determined for nanocrystalline Al and other Al alloys. The present activation energy for the lower temperature regime (T<673K) is extremely small at 1.1 kJ/mol somewhat below that observed by Tellkamp et al. who measured a value of 5.6 kJ/mol in this temperature regime for cryomilled 5083 Al alloy. This regime of behavior appears to be associated with stress relaxation that is perhaps facilitated by annealing of dislocation segments or sub-boundary remnants through thermal vibration within the lattice. The present stabilization of grain size at elevated temperatures appears to be the most effective observed so far for Al alloys. The presence of diamantane deters grain growth apparently by pinning the boundaries based on the consistency of the measured data with the Burke grain growth model.

While the above description has concentrated on the use of aluminum as the metal, any metal may be used without departing from the spirit of the present invention.

Furthermore, while the above description has concentrated on the use of from about 1 to 5 weight percent diamantane, other concentrations of diamantane may be useful in the present invention. For example, as little as about 0.9 weight percent diamantane and even as little as about 0.5 weight percent diamantane may be useful in the present invention. As a further example, as much as about 10 weight percent diamantane may also be useful in the present invention.

It should be understood, of course, that the foregoing relates to exemplary embodiments of the invention and that modifications may be made without departing from the spirit and scope of the invention as set forth in the following claims.

We claim:

1. A stabilized metal consisting essentially of:
nanocrystalline metal particles; and
diamondoid particles.

2. The stabilized metal of claim 1, wherein the stabilized metal has a grain size of less than 100 nm.

3. The stabilized metal of claim 1, wherein the stabilized metal has a grain size of less than 30 nm.

4. The stabilized metal of claim 1, wherein the metal particles are Al particles.

5. The stabilized metal of claim 1, wherein the diamondoid particles are diamantane particles.

6. The stabilized metal of claim 5, wherein the grain size of the stabilized metal after annealing is about two times smaller than that of unstabilized metal particles without the diamantane particles.

7. The stabilized metal of claim 5,wherein the stabilized metal has a thermal stability that is greater than a thermal stability of unstabilized metal particles without the diamantane particles.

8. The stabilized metal of claim 5, wherein the composition of diamantane is given by $C_{dia}=f_{gb}\rho_{dia}/2\ \rho_M$ where $\rho_{dia}$ is the density of the diamantane particles and $\rho_M$ is the density of the metal particles.

9. The stabilized metal of claim 1, wherein the stabilized metal has a grain boundary thickness of about 0.5 nm.

10. The stabilized metal of claim 1, wherein a grain growth temperature regime is observed from 423 to 673K where an activation energy for the stabilized metal is approximately 1KJ/mol.

11. The stabilized metal of claim 1, wherein the stabilized metal exhibits a grain size that remains nanocrystalline after 10 hours at 773K.

12. A metal composition comprising:
nanocrystalline metal particles; and
about 1 to about 5 weight % diamondoid particles, wherein
the grain size of the metal particles after annealing is about two times smaller than that of unstabilized metal particles without the diamondoid particles.

13. The metal composition of claim 12, comprising about 1% diamondoid particles.

14. The stabilized metal of claim 12, wherein the diamondoid particles are diamantane particles.

15. The metal composition of claim 14, wherein the amount of diamantane is given by $C_{dia}=f_{gb}\rho_{dia}/2\ \rho_M$ where $\rho_{dia}$ is the density of the diamantane particles and $p_M$ is the density of the metal particles.

16. The metal composition of claim 12, wherein the composition has a grain size of less than 30 nm.

17. A stabilized cryomilled nanocrystalline aluminium comprising:
nanocrystalline aluminium; and
diamondoid hydrocarbon molecules, wherein
the grain size of the stabilized aluminium after annealing is about two times smaller than that of unstabilized aluminium particles without the diamondoid hydrocarbon molecules.

18. The stabilized cryomilled nanocrystalline aluminium of claim 17 wherein the diamondoid hydrocarbon molecules are present at about 1 weight percent.

19. The stabilized cryomilled nanocrystalline aluminium of claim 17, wherein the diamondoid hydrocarbon molecules are diamantane hydrocarbon molecules.

* * * * *